United States Patent [19]

Raasch

[11] 4,060,208

[45] Nov. 29, 1977

[54] METHOD AND DEVICE FOR IRREGULARIZING OR DISTURBING A WINDING PATTERN IN A WINDING APPARATUS FOR CROSS-WOUND COILS

[75] Inventor: Hans Raasch, Munchen-Gladbach, Germany

[73] Assignee: W. Schlafhorst & Co., Munchen-Gladbach, Germany

[21] Appl. No.: 710,315

[22] Filed: July 30, 1976

[30] Foreign Application Priority Data

July 31, 1975 Germany ..... 2534239

[51] Int. Cl.[2] ..... B65H 54/38

[52] U.S. Cl. ..... 242/18.1

[58] Field of Search ..... 242/18.1, 18 R, 18 DD, 242/43 R

[56] References Cited

U.S. PATENT DOCUMENTS 3,638,872 2/1972 Jennings ..... 242/18.1

*Primary Examiner*—Stanley N. Gilreath

*Attorney, Agent, or Firm*—Herbert L. Lerner

[57] ABSTRACT

Method of irregularizing or disturbing the winding pattern in apparatus for winding cross-wound coils with a constant thread feeding velocity having a reciprocating thread guide which is driven for time intervals alternatingly with at least two different speeds, which includes driving a cross-wound coil in synchronism with and dependent upon the motion of the thread guide so that the quotient of the peripheral speed of the cross-wound coil and the cosine of half the thread crossing angle is constant; and device for carrying out the method.

3 Claims, 7 Drawing Figures

METHOD AND DEVICE FOR IRREGULARIZING OR DISTURBING A WINDING PATTERN IN A WINDING APPARATUS FOR CROSS-WOUND COILS

The invention relates to a method and device for irregularizing or disturbing a winding pattern in a winding apparatus for cross-wound coils with constant thread feeding velocity, and with a reciprocating thread guide which is driven alternatingly at intervals at least at two different speeds.

To effectively disturb or irregularize the winding pattern, a sufficiently large difference in speed is necessary. In heretofore known devices of this general type, the drive which winds the cross-wound coil remains unaffected by the measures for disturbing or irregularizing the pattern. The thread guide velocity influences or determines the thread crossing angle of the cross-wound coil. The crossing angle is thus changed continuously during the irregularization or disturbance of the winding pattern. However, there are limitations to this changing of the crossing angle. It cannot be changed more than ± 5% without producing detrimental effects upon the build-up or formation of the coil and the unwinding behavior thereof. Since the winding speed is given by the resultant of the vectors of peripheral speed of the coil (or peripheral speed of the winding cylinder or roller) and threadguide velocity, the winding speed varies with conventional winding-pattern irregularizing or disturbing methods, causing difficulties when the thread feeding velocity is constant. These difficulties consist mainly of varying thread tension, varying thread stretch or elongation and varying slippage between the winding cylinder and the cross-wound coil in the event the cross-wound coil is driven by a winding cylinder.

It is accordingly an object of the invention to provide a method and device which avoid the foregoing disadvantages of the heretofore known method and devices of this general type and in which the thread is wound on the cross-wound coil with a thread tension and thread elongation that are as uniform as possible with uniform coil formation or build-up.

With the foregoing and other objects in view, there is provided, in accordance with the invention, a method of irregularizing or disturbing the winding pattern in apparatus for winding crosswound coils with a constant thread feeding velocity having a reciprocating thread guide which is driven for time intervals alternatingly with at least two different speeds, which comprises driving a cross-wound coil in synchronism with and dependent upon the motion of the thread guide so that the quotient of the peripheral speed of the cross-wound coil and the cosine of half the thread crossing angle is constant. This results in the desired constant winding speed. If, as usual, the cross-wound coil is driven by a winding cylinder through friction, the peripheral speed of the winding cylinder is equal to the peripheral speed of the cross-wound coil, neglecting the slippage. Since a small amount of slippage is usually desirable, the peripheral speed of the winding cylinder will be slightly higher than the peripheral speed of the cross-wound coil.

In accordance with another feature of the invention, the method includes taking from an auxiliary device connected to a rotating drive of the thread guide an electrical output proportional to the rotary speed of the rotating drive, and applying the electrical output of the auxiliary device to a control of a rotating drive for the coil being cross wound. The auxiliary device may be a tachometer generator, for example.

It is unnecessary to implement the pattern irregularization or disturbance with a continuous change in speed of rotation or with a multiplicity of different speeds of rotation. A sufficiently economical and advantageous limitation is produced when, in accordance with a further feature of the invention, the method comprises selectively switching from one to another speed of rotation differing by approximately 10% from one another for each of the drives in accordance with a parameter of switching selections that includes rhythmic switching and random switching at predetermined time intervals. The transition from one speed to the other can of course, be smooth.

In accordance with the device for carrying out the method of the invention, there are provided separate means for driving the thread guide and for winding the cross-wound coil, and means for controlling both the thread-guide driving means and the cross-wound coil winding means in dependence upon one another, so that the quotient of the peripheral speed of the cross-wound coil and the cosine of half the thread crossing angle is constant. Electrical or mechanical driving or winding means, for example, can be used.

The driving or winding means are usually rotary devices. In the case of the thread guide, the rotary motion is converted into a reciprocating motion.

In accordance with an added feature of the invention, the thread-guide driving means is a first rotating driving device and the cross-wound coil winding means is a second rotating driving device, and including an auxiliary device operatively connected to the first rotating driving device for producing an electrical output proportional to the speed of rotation of the first rotating driving device, and means for applying the electrical output to the second rotating driving device for controlling the rotation of the latter. If a tachometer generator is used as the auxiliary device, then the electrical output is, an electric voltage, for example.

In accordance with yet another feature of the invention, both the driving means and the winding means are each selectively switchable from one to another speed of rotation differing by approximately 10% from one another in accordance with a parameter of switching selections that includes rhythmic switching and random switching at predetermined time intervals.

In accordance with an additional feature of the invention, the device comprises respective gear transmission systems including respective shifting clutches operatively connected to each of the thread-guide driving means, and the cross-wound coil winding means, and further including timing control means for controlling shifting of the shifting clutches.

In accordance with yet a further feature of the invention, a planetary gear transmission system serving as a superimposed transmission system is operatively connected to the cross-wound coil winding means.

In accordance with a concomitant feature of the invention, planetary gear transmission systems drivable dependently upon one another are operatively connected to the thread-guide driving means and the cross-wound coil winding means, respectively, at least one of the planetary gear transmission systems serving as a superimposed transmission system. The superimposition of a non-uniform speed of rotation is accomplished, for example, by elliptic gears.

The advantages achieved with the method and device of the invention are, in particular, that the winding speed suffers no excessive or troublesome change by measures of winding pattern irregularization or disturbance, while thread feed is constant.

Other features which are considered as characteristic for the invention are set forth in the appended claims.

Although the invention is illustrated and described herein as embodied in a method and device for irregularizing or disturbing a winding pattern in a winding apparatus for cross-wound coils, it is nevertheless not intended to be limited to the details shown, since various modifications may be made therein without departing from the spirit of the invention and within the scope and range of equivalents of the claims.

The invention, however, together with additional objects and advantages thereof will be best understood from the following description when read in connection with the accompanying drawings, in which:

FIGS. 1*a*, 1*b* and 1*c* are plot diagrams of different rotary speeds of thread guide driving devices against time for producing winding pattern irregularization or disturbance in accordance with the method and device of the invention;

Figure 1A:
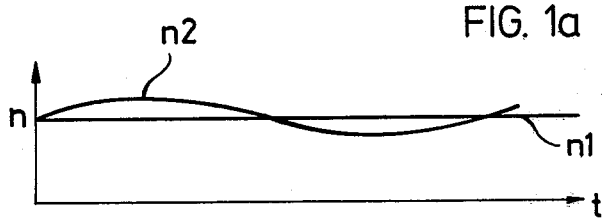
Figure 1B:
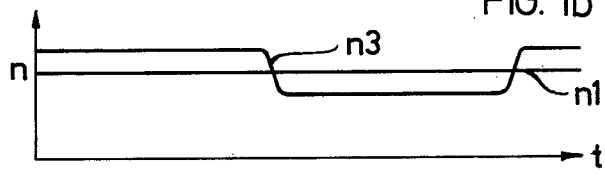
Figure 1C:
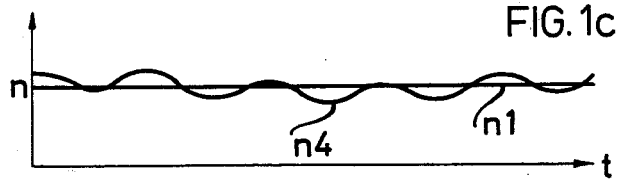

Referring now to the drawing and first, particularly, to FIGS. 1*a*, 1*b* and 1*c* thereof, there is shown how the speed of rotation of the thread guide drive device can be varied periodically for the purpose of pattern irregularization or disturbance. The average or mean speed of rotation is designated by *n*1. According to FIG. 1*a*, a sinusoidally varying speed or rotation *n*2 is superimposed upon the average or mean speed of rotation *n*1. According to FIG. 1*b*, the speed of rotation *n*3 superimposed upon the mean speed of rotation *n*1 is nearly rectangular, and according to FIG. 1*c*, two sinusoidally varying speeds are simultaneously superimposed upon the mean speed of rotation *n*1, the resultant speed being designated as *n*4.

Figure 2:
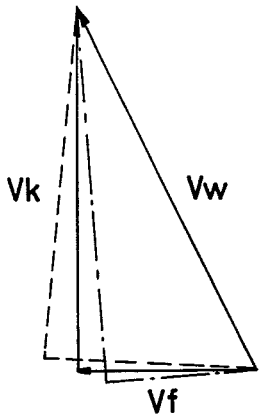
FIG. 2 is a vectorial diagram.

FIG. 2 shows graphically the vectorial addition of the thread guide velocity V*f* and the peripheral velocity V*k* of the cross-wound coil to form the resulting winding velocity V*w*. The angle between the vectors V*k* and V*w* corresponds to half the thread crossing angle $\alpha/2$.

It can be seen from the view of FIG. 2, that an increase of the vector V*f* causes a decrease of the vector V*k* if the vector V*w* is to be maintained constant. This is represented in the drawing by the broken lines. It is also evident that a decrease of V*f* causes an increase of V*k* if V*w* is to remain constant. This is represented in FIG. 2 by the dot-dash lines.

Figure 3:
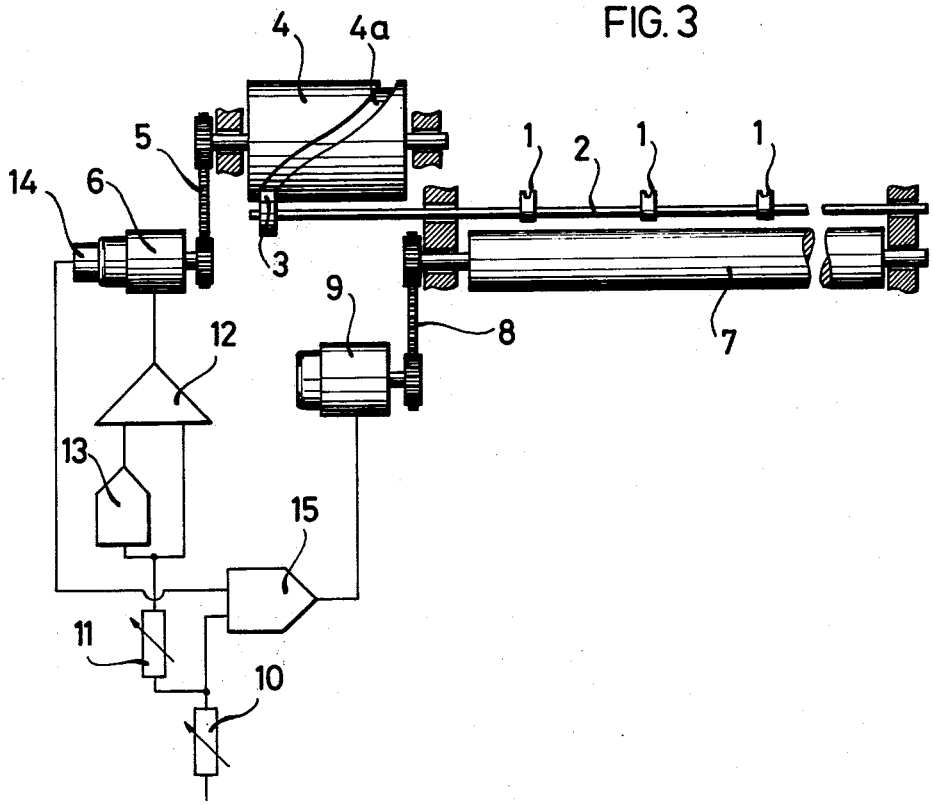
FIG. 3 to 5 are diagrammatic and partly schematic views of different embodiments of the device of the invention.

FIG. 3 shows diagrammatically, the disposition of a drive system for the winding cylinder and the thread guide of a winding apparatus for cross-wound coils with a control system for maintaining the resultant winding velocity constant during pattern disturbance. The symbols used are those generally in use in Germany as well as in the United States. They are the circuit symbols of the German Standard DIN 40700, and have been taken from the October 1969 issue of Analogrechentechnik (Analog Computer Technology). A number of thread guides 1 are mounted on the thread guide bar 2. At the end of the thread guide bar, a control roller 3 is fastened. It is engaged in a groove 4*a* formed in the thread guide-control cylinder 4. The control cylinder is driven by a controlled motor 6 via a serrated belt drive 5. A winding cylinder 7 is driven via a serrated belt drive 8 by a controlled motor 9. Non-illustrated cross-wound coils roll on the winding cylinder 7. They are set in rotation by the winding cylinder 7 through friction. The controlled motors 6 and 9 are constructed so that they deliver a speed which is proportional to the applied voltage. At a setting potentiometer 10, an input voltage for the system is set which is to correspond to the mean winding velocity. A setting potentiometer 11 is connected to an output branch of the potentiometer 10. With this potentiometer 11, the nominal rotary speed of the control cylinder 4 can be set. This setting is predetermined by the desired thread-crossing angle of the non-illustrated cross-wound coil. The output of the potentiometer 11 is divided into two output branches, of which one branch is connected directly to a summing device 12, while the other is fed to a function generator 13. The function generator 13, which is a conventional, commonly used component, modulates the voltage in a manner necessary for the desired pattern disturbance or irregularization characteristic. A function generator which alternates from the function $y = \sin x$ to the function $y = x$, for example, would be suitable. The output of the function generator 13, is a disturbance voltage $y = f(x)$, which is also connected to the summing device 12, along with the one output branch directly connected thereto from the potentiometer 11. The two voltages are added, so that a base voltage with a superimposed disturbance voltage results at the output of the summing device 12. This resultant voltage then causes the controlled motor 6 which drives the thread guide control cylinder 4, to be driven nonuniformly. A tachometer generator 14 is connected to the controlled motor 6, and produces a voltage proportional to the speed of rotation thereof. This voltage is fed to a computer 15 also of known construction, together with a branched output voltage from the potentiometer 10. The voltage present at the output of the computer 15 is set so that the controlled motor 9 following it drives the winding cylinder 7 in such a manner that the resulting winding velocity remains constant. The computer 15 includes a function generator which operates generally according to the formula $y = F(x_1, x_2)$. The exact function produced is:

$$n_x = \frac{nl \cdot \cos\left(\frac{\alpha x}{2}\right)}{\cos\left(\frac{\alpha l}{2}\right)}$$

Where $n_x$ and $\alpha_x$ are the instantaneous winding-cylinder speed of rotation and the instantaneous thread-crossing angle respectively, and where *n*1 and $\alpha$1 are the mean winding-cylinder speed of rotation and the mean thread-crossing angle, respectively.

The slippage between the winding cylinder and the cross-wound coil has been neglected. Otherwise, the computer 15 will feed a preprogrammed additional voltage to the voltage being fed to the controlled motor 9. The additional voltage then compensates for the difference between the peripheral velocities of the cross-wound coil and the winding cylinder resulting from slippage.

Figure 4:
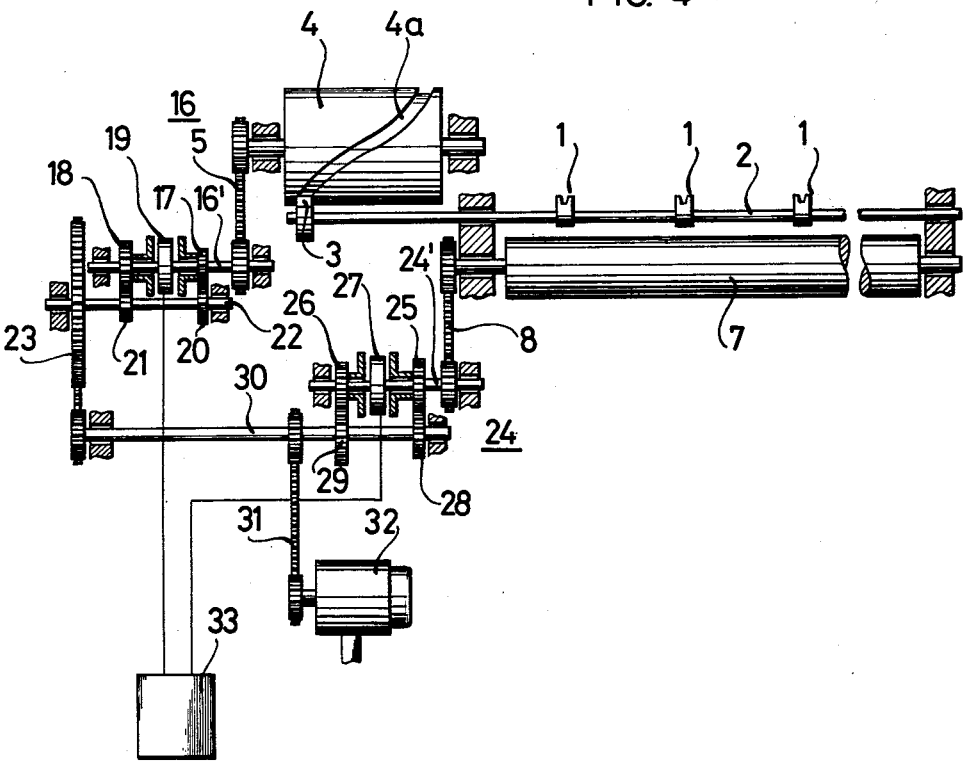

FIG. 4 shows an embodiment of a device in accordance with the invention, with which a winding pattern disturbance or irregularization can be realized, the characteristic of which corresponds to FIG. 1*b*. The thread guide control cylinder 4 is driven via the serrated belt drive 5 by a clutch shaft 16' of a gear transmission 16. Gears 17 and 18 are loosely mounted on the clutch shaft 16'. The gears 17 and 18 can alternatingly be connected for positive force transmission or force-lockingly to the clutch shaft 16' by means of a shifting clutch 19. A gear 20 meshes with the gear 17, and a gear 21 with the gear 18. The gears 20 and 21 are mounted on the shaft 22, which is driven by a serrated belt drive 23. Due to the serrated-belt drive 23, the transmission ratio between the winding cylinder 7 and the thread guide control cylinder 4 is fixed for two predetermined speeds of rotation. The gears 17 and 20 as well as 18 and 21 provide different transmission ratios. They are constructed so as to produce at the non-illustrated cross-wound coil, a maximum thread crossing angle in the one case and a minimum thread crossing angle in the other case, thereby producing the largest possible difference in winding angles. The winding cylinder 7 is driven by the serrated-belt drive 8 via a clutch shaft 24' of a gear transmission 24. Also on this shaft 24', two gears 25 and 26 are loosely mounted and are connectible alternatingly for positive force transmission or force-lockingly to the clutch shaft 24' via a shifting clutch 27. A gear 28 meshes with the gear 25, and a gear 29 with the gear 26. The gears 28 and 29 are mounted on a common shaft 30. The shaft 30 is also associated with the serrated belt drive 23. The shaft 30 is driven via a belt 31 by a motor 32. The transmission ratios between the gears 25/28 and 26/29 are such that, depending upon which pair of gears on the clutch shaft 16' is engaged, the speed of the winding cylinder is set so that the resulting winding velocity remains constant.

The shifting clutches 19 and 27 are switched by a timing control 33 in such a manner that the corresponding pairs of gears for the winding cylinder drive and the drive for the thread-guide cam which produce the desired pattern disturbance are always engaged simultaneously. Infinite possibilities for gear ratios and switching sequences between the four clutch sides exist, of course. The time intervals may be uniform or non-uniform.

Figure 5:
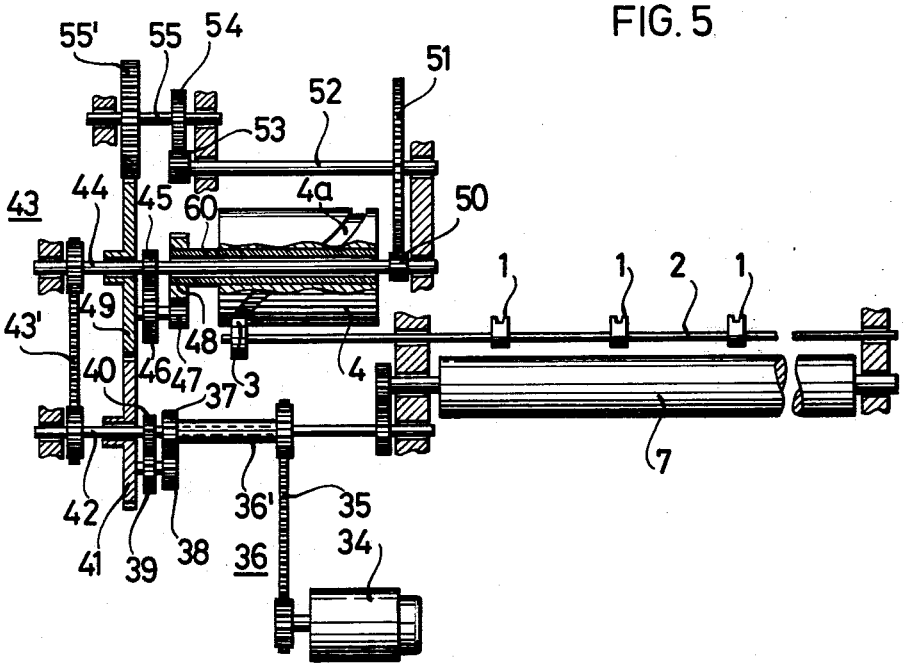

FIG. 5 shows a particularly advantageous device for effecting winding pattern disturbance or irregularization according to the invention. With it, a disturbance or irregularization characteristic according to FIG. 1*a* can be realized. A motor 34 drives a hollow shaft 36' of a planetary gear transmission 36 via a serrated-belt drive 35. A sun gear 37 of the planetary gear transmission 36 is mounted on the hollow shaft 36'. A planetary gear 38, to which a planetary gear 39 is connected, meshes with the sun gear 37. The planetary gear 39 meshes with an output sun gear 40. The planetary gears 38 and 39 are fastened to the arm 41, which is also constructed as a gear. The output sun gear 40 is mounted on a shaft 42. The shaft 42 extends through the hollow shaft 36' and, via a pair of meshing spur gears, drives the winding cylinder 7. The shaft 42, via another spur gear and a serrated belt drive 43', drives a further planetary gear transmission 43. The transmission of the serrated-belt drive 43' determines the thread crossing angle on the non-illustrated cross-wound coil. On a driven shaft 44 of the planetary gear transmission 43, there is mounted a driving sun gear 45, which meshes with a planetary gear 46. A planetary gear 47, which meshes with an output sun gear 48, is connected to the planetary gear 46. The output sun gear 48 is mounted on a hollow shaft 60, on which the thread guide control cylinder 4 is also mounted. The planetary gears 47 and 46 are connected to the arm 49, which also is constructed as a gear and meshes with the gear-shaped arm 41 of the planetary gear transmission 36. At the end of the shaft 44, there is mounted a pinion 50 which meshes with a gear 51. The gear 51 is fastened on a shaft 52, at the other end of which an elliptic gear 53 is mounted. The elliptic gear 53 meshes with an elliptic gear 54, which is connected via a shaft 55 to a gear 55'. The gear 55' meshes with the gear-like arm 49 of the planetary gear transmission 43. Through this construction, a nonuniform rotary speed is superimposed upon the thread-guide planetary gear transmission 43 via the elliptic gears 53, 54. This superimposed speed is also fed to the gear-like arm 41 of the winding-cylinder planetary gear transmission 36. The transmission of the winding-cylinder planetary gear transmission 36 is determined so that the winding cylinder speed is set for a given thread crossing angle in such a manner that the resultant winding velocity remains practically constant. Although the relationship between the thread guide velocity and the winding cylinder velocity for obtaining a constant resultant winding velocity is a trigonometric function, and a planetary gear transmission system operates only as a summing transmission, the desired aim of keeping the winding velocity constant within the limits of varying the thread crossing angle required for winding pattern irregularization or disturbance, is achieved with very good accuracy. Within the usual range of commonly found thread crossing angles of 25° to 40°, the combination of transmissions operates with satisfactory accuracy if the transmission ratios are calculated by taking as the basis of the calculation, the mean thread crossing angle of the entire range. With this construction, it is not only possible to superimpose a sinusoidal disturbance velocity on the mean thread guide vleocity, but other functions can also be superimposed via the gear-like arm 49 of the thread guide planetary gear transmission 43. These velocity changes are compensated for in the same manner by the winding cylinder planetary gear transmission 36 through a change of the winding cylinder speed of rotation. It is a particular advantage of this construction that the change in rotary speed of the winding cylinder takes place without time delay when the velocity of the thread guide changes.

There are claimed:

1. In apparatus for winding cross-wound coils with a constant thread feeding velocity having a reciprocating thread guide, means for reciprocating the thread guide and means for driving the reciprocating means for time intervals alternatingly with at least two different speeds, a device for irregularizing or disturbing the winding pattern in the apparatus comprising separate means for driving the thread guide and for winding the cross-wound coil, means for controlling both said thread guide driving means and said cross-wound coil winding means in dependence upon one another, so that the quotient of the peripheral speed of the cross-wound coil and the cosine of half the thread crossing angle is constant, both said driving means and said winding means being each selectively switchable from one to another speed of rotation differing by approximately 10% from one another in accordance with a parameter of switching selections that includes rhythmic switching and random switching at predetermined time intervals, and gear transmission systems including respective shifting clutches operatively connected to each of said thread-guide driving means and said cross-wound coil winding means, and timing control means for controlling shifting of said shifting clutches.

2. In apparatus for winding cross-wound coils with a constant thread feeding velocity having a reciprocating thread guide, means for reciprocating the thread guide and means for driving the reciprocating means for time intervals alternatingly with at least two different speeds, a device for irregularizing or disturbing the winding pattern in the apparatus comprising separate means for driving the thread guide and for winding the cross-wound coil, means for controlling both said thread-guide driving means and said cross-wound coil winding means in dependence upon one another, so that the quotient of the peripheral speed of the cross-wound coil and the cosine of half the thread crossing angle is constant, and a planetary gear transmission system serving as a superimposed transmission system operatively connected to said cross-wound coil winding means.

3. In apparatus for winding cross-wound coils with a constant thread feeding velocity having a reciprocating thread guide, means for reciprocating the thread guide and means for driving the reciprocating means for time intervals alternatively with at least two different speeds, a device for irregularizing or disturbing the winding pattern in the apparatus comprising separate means for driving the thread guide and for winding the cross-wound coil, means for controlling both said thread-guide driving means and said cross-wound coil winding means in dependence upon one another, so that the quotient of the peripheral speed of the cross-wound coil and the cosine of half the thread crossing angle is constant, and planetary gear transmission systems drivable dependently upon one another operatively connected to said thread-guide driving means and said cross-wound coil winding means, respectively, at least one of said planetary gear transmission systems serving as a superimposed transmission system.

* * * * *